United States Patent [19]

Aron et al.

[11] 4,186,040

[45] Jan. 29, 1980

[54] "BZ" CONTAINING PYROTECHNIC COMPOSITIONS

[75] Inventors: Gunter Aron; Carl H. Hassis, both of Alexandria, Va.

[73] Assignee: The United States of America as represented by the Secretary of the Army, Washington, D.C.

[21] Appl. No.: 415,512

[22] Filed: Dec. 2, 1964

[51] Int. Cl.[2] ..... C06B 45/10

[52] U.S. Cl. ..... 149/19.4; 149/2; 149/19.92; 149/20; 149/76; 149/82; 149/83; 424/40

[58] Field of Search ..... 149/17–19, 149/19.4, 76, 2, 82, 83, 20, 19.92; 167/47; 424/40

[56] References Cited

U.S. PATENT DOCUMENTS

| | | | |
|---|---|---|---|
| 2,768,072 | 10/1956 | Stark | 149/92 |
| 2,845,025 | 7/1958 | Stark | 149/92 |
| 3,198,677 | 8/1965 | Thomas | 149/19 |

*Primary Examiner*—Edward A. Miller

*Attorney, Agent, or Firm*—Nathan Edelberg

EXEMPLARY CLAIM

1. A solid, pyrotechnic composition for dissemination of 3-quinuclidinyl benzylete, said composition consisting essentially of 3-quinuclidinyl benzylete and an oxidizer selected from the group consisting of ammonium and alkali metal chlorates and perchlorates, incorporated in a solid foamed polyurethane binder.

12 Claims, No Drawings

"BZ" CONTAINING PYROTECHNIC COMPOSITIONS

This invention relates to porous solid, pyrotechnic compositions for dissemination of BZ and to methods of making such compositions.

The letters BZ refer to 3-quinuclidinyl benzylete, a chemical warfare agent.

Chemical warfare objectives make it desirable to incorporate BZ into a combustible composition which, upon combustion, vaporizes the BZ. An effective BZ disseminating composition should have sufficient physical and chemical stability to resist damage or deterioration when subjected to rough handling or storage under varying environmental conditions. In addition the combustion characteristics should permit vaporization of BZ with a minimum amount of destruction of the BZ.

Accordingly, it is an object of this invention to provide physically strong and chemically stable pyrotechnic compositions for the dissemination of BZ. Another object is to provide BZ dissemination compositions having burning characteristics such that BZ is effectively vaporized with a minimum of thermal decomposition. A still further object is to provide methods of making such compositions.

Basically, the invention consists of incorporating particulate BZ; a solid oxidizer; and, if desired, a fuel into a foamed polyurethane binder. The porous, foamed structure provides a large burning surface which produces a high flow rate of combustion gases. The BZ vaporized by burning of the composition is quickly removed from the combustion zone by entrainment in the combustion gases. Thus, thermal decomposition is minimized. The compositions are physically strong and chemically stable.

Preferably, the polyurethane binders used in this invention are prepared by reacting an aromatic diisocyanate such as toluene diisocyanate; a lower molecular weight alcohol such as methanol or ethylene glycol; and polyethylene glycol having a molecular weight of about 400. Lithium perchlorate is generally dissolved in the lower molecular weight alcohol to increase the burning rate of the binder. The fact that lithium perchlorate is soluble permits its incorporation as an oxidizer without increasing the solid loading of the composition. Since BZ contains an acyclic amine group, polymerization of the binder is catalyzed by its addition and the rate of polymerization can be controlled by the rate of addition.

An amine polyol such as Quadrol (N,N,N',N',-tetrakis[2-hydroxypropyl] ethylene diamine) can be substituted for the polyethylene glycol. However, since such a polyol contains amine groups which catalyze polymerization, the rate of polymerization cannot be as closely controlled by the rate of BZ addition. In addition to BZ, fuels such as finely-divided aluminum or sulfur, solid oxidizers such as ammonium and alkali metal chlorates and perchlorates, and burning rate modifiers such as $Fe_2O_3$ may be added to the polymerization mix prior to cure.

The mix is preferably foamed by use of a volatile liquid blowing agent which is a diluent for the polyurethane binder ingredients but is not a solvent for the BZ. Freon 113 (trichlorotrifluoroethane), acetone, and methyl ethyl ketone, are examples of blowing agents which may be used. These liquid blowing agents impede polymerization, extend the pot-life of the mix, and also serve as a slurrying medium during mixing and casting of the formulation. Water which reacts with the isocyanate to yield $CO_2$ is also an effective blowing agent. The blowing agent is volatilized during cure of the polymerization mix to produce a porous structure.

The mix should be cured at temperatures below 120° C. to prevent undesirable side reactions such as biurete and allophonate formation. If desired, conventional vacuum curing techniques may be employed to facilitate removal of the blowing agent. As is well known to those skilled in the art, polyurethane foams of desired density can be obtained by varying the curing conditions and the relative concentrations of the reactants and blowing agents.

The compositions may be prepared by merely mixing the components or by prepolymer techniques. In the latter process a prepolymer containing excess isocyanate groups is prepared, for example, by reacting methanol and toluene diisocyanate at about 60° C. Lithium perchlorate is dissolved in the liquid prepolymer and polyethylene glycol and blowing agent are added to form a mixture which is liquid at ambient temperatures. Addition of the liquid blowing agent impedes further polymerization. Addition of BZ catalyzes an exothermic cure.

In some instances, physical properties of the composition may be improved by substitution of a plasticizer such as diallyl phthalate for a portion of the diisocyanate.

The following examples are illustrative of BZ disseminating compositions prepared according to this invention:

EXAMPLE 1

A mixture of the following components was prepared:

| Ingredient | Weight % |
|---|---|
| Quadrol | 6.18 |
| Toluene diisocyanate | 7.07 |
| 1:1:1 solution of lithium perchlorate in ethylene glycol | 6.18 |
| $Fe_2O_3$ | 0.25 |
| Aluminum | 2.76 |
| Ammonium perchlorate | 27.56 |
| BZ | 50.00 |

Forty parts by weight of Freon 113 were added to each 100 parts of the formulation. The Freon 113 served as a slurrying medium and pot-life extender as well as blowing agent. The mix was cured for one-half hour at 55° C. at an absolute pressure of 20 inches of mercury. The resulting porous composition burned at a rate of 0.213 inches/sec. The flame temperature was 1142° K.

EXAMPLE 2

A mixture similar to that described in Example 1 but without aluminum was prepared and cured. The cured composition burned with a flame temperature of 988° K. The burning rate was not appreciably changed.

EXAMPLE 3

The following mixture was prepared:

| Ingredient | Weight % |
|---|---|
| Toluene diisocyanate | 14.32 |
| Methanol | 1.57 |

-continued

| Ingredient | Weight % |
|---|---|
| Lithium perchlorate | 2.35 |
| Polyethylene glycol (molecular wt. 400) | 6.66 |
| Aluminum | 2.59 |
| Ammonium perchlorate | 22.6 |
| $Fe_2O_3$ | 0.25 |
| BZ | 50.00 |

Freon 113 was used as blowing agent. The cured mix burned with a flame temperature of 980° K. Over 32% by weight of the BZ added to the mix was recovered.

EXAMPLE 4

The following mixture was prepared:

| Ingredient | Weight % |
|---|---|
| Toluene diisocyanate | 8.562 |
| Methanol | 1.576 |
| Diallyl phthalate | 5.824 |
| Lithium perchlorate | 2.360 |
| Polyethylene glycol (Molecular wt. 400) | 6.678 |
| Potassium chlorate | 19.554 |
| Sulfur | 5.114 |
| $Fe_2O_3$ | 0.250 |
| BZ | 50.082 |

Freon 113 was used as a diluent and blowing agent for the system. Curing was accomplished at 60° C. under vacuum. Over 50% by weight of the BZ added to the mix was recovered when the sample was burned.

EXAMPLE 5

A mix similar to that described in Example 4 was prepared. Acetone was substituted for Freon 113 as the diluent and blowing agent. The cured composition burned satisfactorily and over 50% by weight of the BZ added to the mix was recovered.

Other embodiments of this invention within the scope of the claims will be apparent to those skilled in the art.

We claim:

1. A solid, pyrotechnic composition for dissemination of 3-quinuclidinyl benzylete, said composition consisting essentially of 3-quinuclidinyl benzylete and an oxidizer salected from the group consisting of ammonium and alkali metal chlorates and perchlorates, incorporated in a solid foamed polyurethane binder.

2. The composition of claim 1, wherein a solid, finely-divided fuel is dispersed within the foamed polyurethane binder.

3. The composition of claim 2, wherein said solid, finely-divided fuel is selected from the group consisting of aluminum and sulfur.

4. The composition of claim 1, wherein said polyurethane binder is the reaction product of a polymerization mix consisting essentially of an aromatic diisocyanate, an alcohol which is a solvent for lithium perchlorate, and polyethylene glycol having a molecular weight of about 400.

5. The composition of claim 4 wherein said polymerization mix contains dissolved lithium perchlorate.

6. A solid, pyrotechnic composition for the dissemination of 3-quinuclidinyl benzylete, said composition consisting essentially of 3-quinuclidinyl benzylete, potassium chlorate, and sulfur, incorporated in a solid, foamed polyurethane binder, said polyurethane binder being the cured reaction product of a polymerization mix consisting essentially of toluene diisocyanate, methanol, and polyethylene glycol having a molecular weight of about 400, said polymerization mix containing dissolved lithium perchlorate.

7. The composition of claim 6 wherein said composition contains at least 50% by weight of 3-quinuclidinyl benzylete.

8. A solid, pyrotechnic composition for the dissemination of 3-quinuclidinyl benzylete, said composition consisting essentially of at least 50% by weight of 3-quinuclidinyl benzylete, finely-divided aluminum and ammonium perchlorate dispersed within a solid, foamed polyurethane binder, said foamed polyurethane binder being the cured reaction product of a polymerization mix consisting essentially of toluene diisocyanate, methanol, and polyethylene glycol having a molecular weight of about 400, said polymerization mix containing dissolved lithium perchlorate.

9. A process of making a solid pyrotechnic composition for dissemination of 3-quinuclidinyl benzylete, said process comprising admixing 3-quinuclidinyl benzylete, and a solid oxidizer selected from the group consisting of ammonium and alkali metal chlorates and perchlorates into a polymerization mix containing essentially of toluene diisocyanate, an alcohol containing dissolved lithium perchlorate, polyethylene glycol having a molecular weight of about 400, and a volatile diluent for the components of said polymerization mix, said diluent being a nonsolvent for 3-quinuclidinyl benzylete, and simultaneously curing the mixture and volatilizing said diluent.

10. The process of claim 9 further comprising admixing a fuel selected from the group consisting of aluminum and sulfur into said polymerization mix.

11. A process of making a solid, pyrotechnic composition for dissemination of 3-quinuclidinyl benzylete, said process comprising, adding 3-quinuclidinyl benzylete, and a solid oxidizer selected from the group consisting of ammonium and alkali metal perchlorates to a binder mix prepared by addition of polyethylene glycol having a molecular weight of about 400 and a diluent for said binder mix, said diluent being a nonsolvent for 3-quinuclidinyl benzylete, to a prepolymer mix of toluene diisocyanate and methanol, said prepolymer mix having excess isocyanate groups and containing dissolved lithium perchlorate and simultaneously curing the composition and volatilizing said diluent.

12. The process of claim 11 further comprising adding a fuel selected from the group consisting of aluminum and sulfur to said binder mix.

* * * * *